US009056740B2

(12) United States Patent
Aruga

(10) Patent No.: US 9,056,740 B2
(45) Date of Patent: Jun. 16, 2015

(54) MEDIA PROCESSING DEVICE AND CONVEYANCE UNIT FOR REVERSING PAPER

(71) Applicant: Seiko Epson Corporation, Tokyo (JP)

(72) Inventor: Yuichi Aruga, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/200,685

(22) Filed: Mar. 7, 2014

(65) Prior Publication Data

US 2014/0265108 A1 Sep. 18, 2014

(30) Foreign Application Priority Data

Mar. 15, 2013 (JP) ..... 2013-053235

(51) Int. Cl.

| | |
|---|---|
| ***B65H 39/10*** | (2006.01) |
| ***B65H 15/00*** | (2006.01) |
| ***B65H 5/26*** | (2006.01) |
| ***B65H 5/06*** | (2006.01) |
| ***B65H 85/00*** | (2006.01) |

(52) U.S. Cl.

CPC ..... *B65H 15/00* (2013.01); *B65H 5/26* (2013.01); *B65H 5/062* (2013.01); *B65H 85/00* (2013.01)

(58) Field of Classification Search

CPC ..... B65H 9/002; B65H 15/00; B65H 85/00; B41F 21/106; B41J 3/60; G03B 27/6257; G03G 15/23; H04N 1/00572

USPC ..... 271/291, 301, 186

See application file for complete search history.

(56) References Cited

U.S. PATENT DOCUMENTS

| | | | | |
|---|---|---|---|---|
| 6,585,258 | B1 * | 7/2003 | Hirota et al. | 271/186 |
| 7,896,343 | B2 * | 3/2011 | Iwago et al. | 271/301 |
| 2006/0164491 | A1 | 7/2006 | Sakuma et al. | |
| 2013/0069300 | A1 * | 3/2013 | Tamehira et al. | 271/10.13 |

FOREIGN PATENT DOCUMENTS

| | | | |
|---|---|---|---|
| JP | 4111497 | B2 | 7/2008 |
| JP | 2010-280454 | A | 12/2010 |

* cited by examiner

*Primary Examiner* — David H Bollinger

(74) *Attorney, Agent, or Firm* — Nutter McClennen & Fish LLP; John J. Penny, Jr.; Joshua I. Rudawitz

(57) ABSTRACT

A printer absorbs conveyance speed differences between a conveyance mechanism and a reversing conveyance mechanism with a simple configuration. A printer 1 has a reversing conveyance mechanism 38 that reverses the front and back and returns printing paper P supplied from a main conveyance mechanism 17 to the main conveyance mechanism 17. The reversing conveyance mechanism 38 has a first reversing conveyance roller 31, and a first gear train 51 that transfers drive power from a reversing conveyance motor 39. A backlash part 70 enabling relative rotation in a preset angular range between the first final gear 64 and first reversing conveyance roller 31 is disposed between the first final gear 64 of the first gear train 51 and the first reversing conveyance roller 31.

14 Claims, 9 Drawing Sheets

MEDIA PROCESSING DEVICE AND CONVEYANCE UNIT FOR REVERSING PAPER

BACKGROUND

1. Technical Field

The present invention relates to a media processing device having a reversing conveyance path for reversing the front and back sides of printing paper or other sheet media, and a reversing conveyance mechanism that conveys the medium through the reversing conveyance path.

2. Related Art

Examples of such media processing devices include printers with an automatic two-sided (duplex) printing capability, and scanners and fax machines with an automatic two-sided (duplex) scanning (reading) capability. In a printer with a duplex printing capability, the printing paper is first conveyed through a conveyance path past the printing position of the printhead, and the first side (front) is printed. The paper is then fed from this conveyance path into a reversing conveyance path and conveyed through the reversing conveyance path to reverse the front and back sides. The reversed paper is then returned from the reversing conveyance path to the main conveyance path and fed through the main conveyance path again to print on the back side.

JP-A-2010-280454 discloses a printer of this type. In the printer described in JP-A-2010-280454 the conveyance mechanism that conveys the printing paper through the conveyance path past the printing position, and the conveyance mechanism for reversing the paper, are driven by separate drive sources.

Synchronizing and controlling driving two conveyance mechanisms with separate drive sources so that the conveyance speeds of the conveyance mechanisms are exactly the same is difficult. As a result, when the media is passed between the two conveyance mechanisms, the media may go slack or be pulled with too tension due to the difference in the conveyance speeds, and media conveyance is therefore not stable.

Japan Patent No. 4111497 teaches technology for absorbing the difference in the conveyance speeds of the two conveyance mechanisms when the medium is passed therebetween. The technology disclosed in Japan Patent No. 4111497 provides the conveyance roller of the conveyance mechanism on the side that supplies the media with a one-way clutch that spins freely due to the difference in conveyance speed, and drives the conveyance mechanism on the media supply side at a slower conveyance speed than the conveyance speed of the conveyance mechanism on the side that receives the media. The technology disclosed in Japan Patent No. 4111497 enables absorbing the difference in conveyance speed because the paper feed roller of the conveyance mechanism on the side supplying the medium turns following the medium conveyed by the conveyance mechanism on the side that receives the medium.

The difference in the conveyance speeds of the conveyance mechanism and the reversing mechanism can be absorbed by applying the technology disclosed in Japan Patent No. 4111497 to the printer disclosed in JP-A-2010-280454. However, this increases the manufacturing cost of the device because disposing a one-way clutch to the paper feed roller of the conveyance mechanism increases the number of parts.

SUMMARY

The media processing device according to the present invention uses a simple configuration to absorb the difference in the conveyance speeds of the conveyance mechanism and the reversing mechanism. A conveyance unit for reversing paper also absorbs the difference in the conveyance speeds of the reversing mechanism and an external conveyance mechanism that feeds media into the reversing mechanism by means of a simple configuration.

A media processing device according to one aspect of the invention has: a conveyance path that guides a sheet medium and through which the sheet medium is conveyed; a drive source that can be driven forward and reverse; a conveyance mechanism that conveys the medium in one direction through the conveyance path when the drive source is driven forward, and conveys the medium in the opposite direction through the conveyance path when the drive source is driven in reverse; a reversing conveyance path that reverses the front and back of the medium supplied from the conveyance path by the conveyance mechanism by the drive source being driven in reverse, and returns the medium to the conveyance path; a reversing conveyance mechanism that receives and conveys the medium fed into the reversing conveyance path through the reversing conveyance path, and then feeds the medium into the conveyance path, and passes the medium to the conveyance mechanism being driven forward by the drive source; a reversing drive source that is separate from the drive source and drives the reversing conveyance mechanism; and a backlash part. The reversing conveyance mechanism includes a reversing conveyance roller, and a gear train that transfers drive power from the reversing drive source to the reversing conveyance roller. The backlash part enables relative rotation in a preset angular range between two gears to which the drive power of the reversing drive source is directly transferred in the gear train, or between the final gear of the gear train and the reversing conveyance roller.

This aspect of the invention has a backlash part between two gears in the gear train, or between the final gear of the gear train and the reversing conveyance roller. When there is a difference between the conveyance speed of the conveyance mechanism and the conveyance speed of the reversing conveyance roller, the reversing conveyance roller turns through the backlash part in conjunction with the medium conveyed by the conveyance mechanism, and can therefore absorb the difference in conveyance speeds. More specifically, the difference in the conveyance speeds of the conveyance mechanism and reversing conveyance mechanism can be absorbed by simply providing a backlash part.

To assure sufficient length in the reversing conveyance path and convey media through a long reversing conveyance path, the reversing conveyance mechanism preferably has a first reversing conveyance roller and a second reversing conveyance roller as the reversing conveyance roller, and includes a first gear train that transfers the drive power of the reversing drive source to the first reversing conveyance roller, and a second gear train that transfers the drive power of the reversing drive source to the second reversing conveyance roller, as the gear train; the first reversing conveyance roller conveys the medium with the conveyance mechanism when the medium is received from the conveyance mechanism; and the second reversing conveyance roller conveys the medium with the conveyance mechanism when passing the medium to the conveyance mechanism.

Further preferably, the conveyance speed of the reversing conveyance mechanism is slower than the conveyance speed of the conveyance mechanism. This configuration enables easily absorbing the difference in the conveyance speeds of the conveyance mechanism and reversing conveyance mechanism using the backlash part.

Further preferably, the media conveyance force of the reversing conveyance mechanism is less than the media conveyance force of the conveyance mechanism. This configuration enables absorbing the difference in the conveyance speeds by the paper slipping against the reversing conveyance roller when the conveyance speed of the reversing conveyance mechanism is faster than the conveyance speed of the conveyance mechanism, for example.

To configure a backlash part more easily, the backlash part is preferably disposed between the coaxially disposed final gear and reversing conveyance roller.

A backlash part can be easily provided by a configuration in which the reversing conveyance roller has a pin protruding radially from the center shaft part; the final gear has a first contact part that contacts the pin from one side and a second contact part that contacts the pin from the other side around the axis of rotation; and the final gear and the reversing conveyance roller can rotate relative to each other in the range of the pin moving between the first contact part and the second contact part.

Another aspect of the invention is a paper reversing conveyance unit including: a reversing conveyance path that reverses the front and back of a medium supplied from an external part through an external conveyance mechanism that conveys sheet media and is driven by a drive source drivable forward and reverse, and returns the medium to the external conveyance mechanism; a reversing conveyance mechanism that receives and conveys the medium fed into the reversing conveyance path from the external conveyance mechanism being driven in reverse by the drive source through the reversing conveyance path, and then passes the medium to the external conveyance mechanism being driven forward by the drive source; a reversing drive source that drives the reversing conveyance mechanism; and a backlash part. The reversing conveyance mechanism including a reversing conveyance roller, and a gear train that transfers drive power from the reversing drive source to the reversing conveyance roller; and the backlash part enabling relative rotation in a preset angular range between two gears to which the drive power of the reversing drive source is directly transferred in the gear train, or between the final gear of the gear train and the reversing conveyance roller.

This aspect of the invention has a backlash part between two gears in the gear train, or between the final gear of the gear train and the reversing conveyance roller. When there is a difference between the conveyance speed of the external conveyance mechanism that feeds the medium into the reversing conveyance unit and the conveyance speed of the reversing conveyance roller, the reversing conveyance roller turns through the backlash part in conjunction with the medium conveyed by the external conveyance mechanism, and can therefore absorb the difference in conveyance speeds. More specifically, the difference in the conveyance speeds of the external conveyance mechanism and reversing conveyance mechanism can be absorbed by simply providing a backlash part.

To assure sufficient length in the reversing conveyance path and convey media through a long reversing conveyance path, the reversing conveyance mechanism preferably has a first reversing conveyance roller and a second reversing conveyance roller as the reversing conveyance roller, and includes a first gear train that transfers the drive power of the reversing drive source to the first reversing conveyance roller, and a second gear train that transfers the drive power of the reversing drive source to the second reversing conveyance roller, as the gear train; the first reversing conveyance roller conveys the medium with the external conveyance mechanism when the medium is received from the external conveyance mechanism; and the second reversing conveyance roller conveys the medium with the external conveyance mechanism when passing the medium to the external conveyance mechanism.

Further preferably, the conveyance speed of the reversing conveyance mechanism is slower than the conveyance speed of the external conveyance mechanism. This configuration enables easily absorbing the difference in the conveyance speeds of the external conveyance mechanism and reversing conveyance mechanism using the backlash part.

Further preferably, the media conveyance force of the reversing conveyance mechanism is less than the media conveyance force of the external conveyance mechanism. This configuration enables absorbing the difference in the conveyance speeds by the paper slipping against the reversing conveyance roller when the conveyance speed of the reversing conveyance mechanism is faster than the conveyance speed of the external conveyance mechanism, for example.

To configure a backlash part more easily in this aspect of the invention, the backlash part is preferably disposed between the coaxially disposed final gear and reversing conveyance roller.

A backlash part can be easily provided by a configuration in which the reversing conveyance roller has a pin protruding radially from the center shaft part; the final gear has a first contact part that contacts the pin from one side and a second contact part that contacts the pin from the other side around the axis of rotation; and the final gear and the reversing conveyance roller can rotate relative to each other in the range of the pin moving between the first contact part and the second contact part.

Other objects and attainments together with a fuller understanding of the invention will become apparent and appreciated by referring to the following description and claims taken in conjunction with the accompanying drawings.

DESCRIPTION OF EMBODIMENTS

An inkjet printer is described below as an example of a preferred embodiment of a media processing device according to the invention.

General Configuration of a Printer

Figure 1:
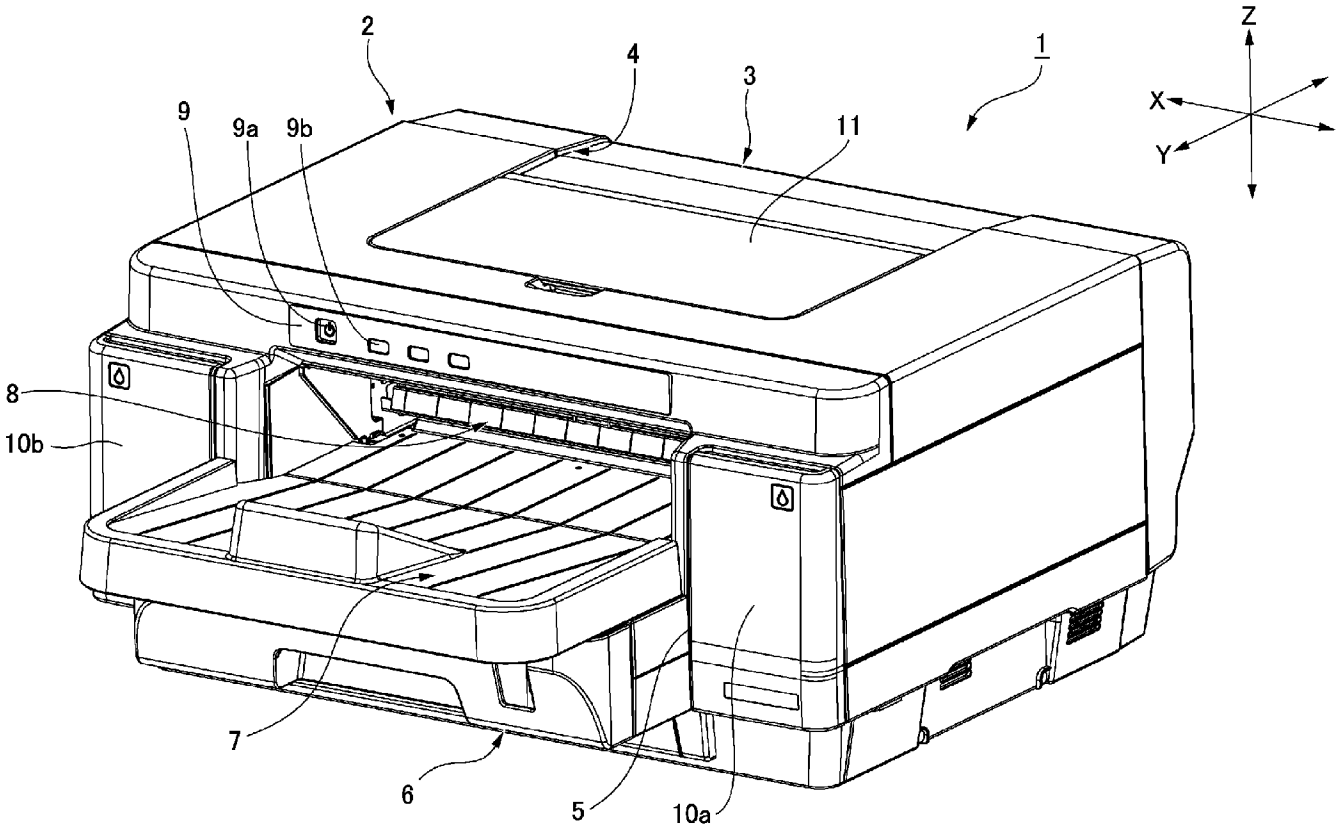
FIG. 1 is an oblique front view of a printer according to the invention.
Figure 2:
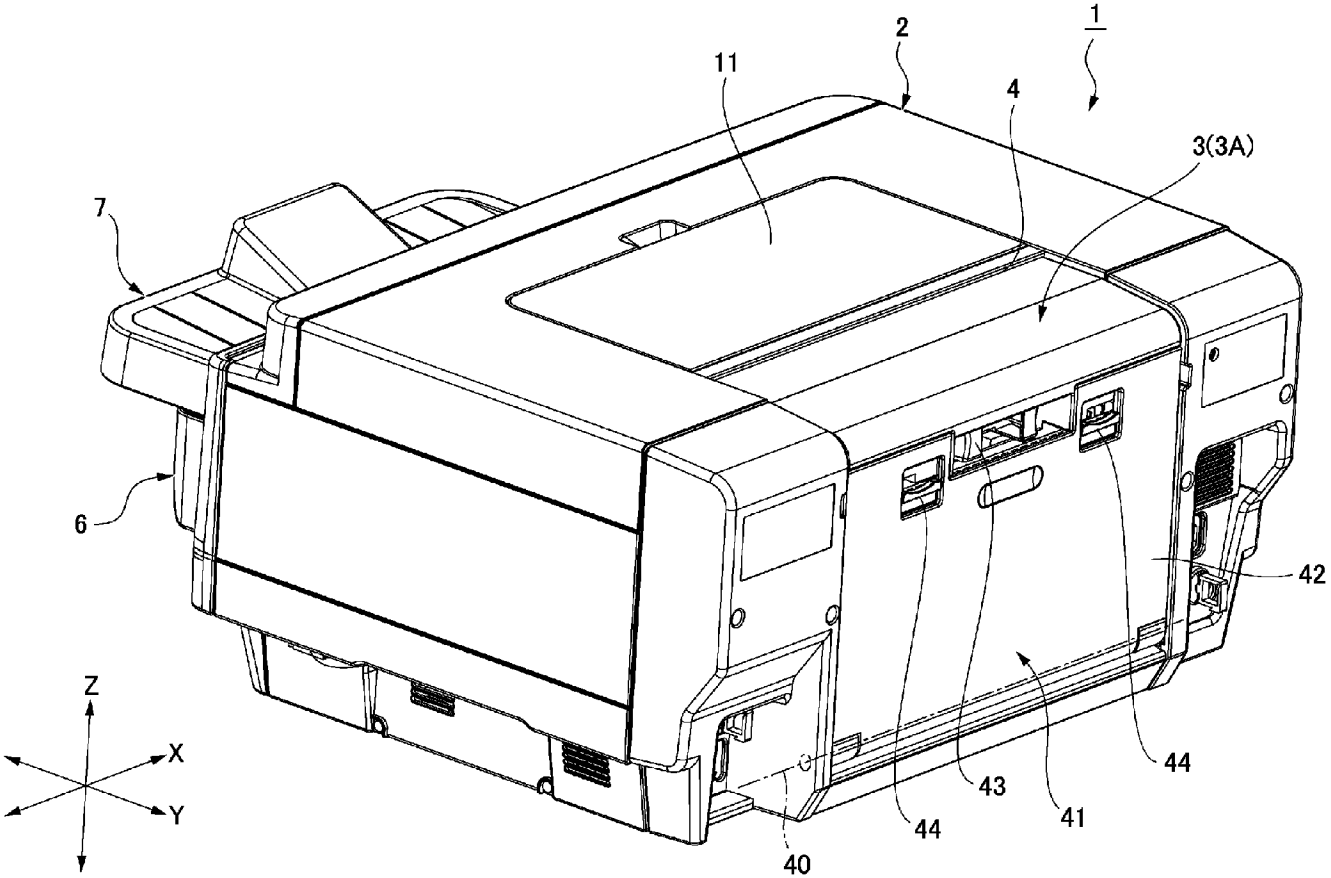
FIG. 2 is an oblique rear view of a printer according to the invention.

FIG. 1 is an external oblique view from the front of an inkjet printer ("printer" below) according to this embodiment of the invention. FIG. 2 is an external oblique view of the printer from the back when the reversing unit is closed.

The general configuration of the printer 1 is described referring primarily to FIG. 1 and FIG. 2. The printer 1 has a printer cabinet 2 and a reversing unit (conveyance unit for reversing paper) 3. The printer cabinet 2 has a basically rectangular box-like shape that is long on the transverse axis X widthwise to the printer. A recess 4 is formed in the middle of the back of the printer cabinet 2, and the reversing unit 3 is installed in this recess 4. The reversing unit 3 is a unit for reversing the front and back sides of the printing paper ("paper" below), which is a form of sheet media, and then returning the reversed paper into the printer cabinet 2.

A paper cassette loading unit 5 is disposed to the front of the printer cabinet 2. The paper cassette loading unit 5 opens to the front of the printer (the front on the longitudinal axis Y) at a position toward the bottom on the vertical axis Z in the front of the printer cabinet 2. A paper cassette 6 can be loaded from the front into the paper cassette loading unit 5. A paper discharge tray 7 is attached above the paper cassette loading unit 5. The front part of the paper discharge tray 7 protrudes from the front of the printer. A rectangular paper exit 8 extending toward the back of the printer (the back on the longitudinal axis Y) is formed above the paper discharge tray 7.

An operating panel 9 is at the front of the printer above the paper exit 8. The operating panel 9 includes a power switch 9*a* and a plurality of state indicators 9*b*. Rectangular access doors 10*a*, 10*b* are attached to the front of the printer on opposite sides of the paper discharge tray 7 and paper exit 8. When the access doors 10*a*, 10*b* are open, the ink cartridge loading unit (not shown in the figure) opens and the ink cartridges (not shown in the figure) can be replaced.

The top of the printer is flat, and has an access cover 11 attached in the middle for maintenance.

The reversing unit 3 can open and close, and opens to the back of the printer pivoting at the bottom on the vertical axis Z of the printer. When in the closed position 3A shown in FIG. 2, the reversing unit 3 is standing upright on the vertical axis Z in the recess 4, and the back cover 42 of the reversing unit case 41 is positioned substantially flush with the back left and right sides of the printer cabinet 2. A lever operating unit 43 for opening and closing the reversing unit 3 is disposed at the top of the reversing unit 3. A pair of operating levers 44 for opening and closing the back cover 42 are disposed on opposite sides of the lever operating unit 43 on the transverse axis X.

Internal Configuration of the Printer

Figure 3:
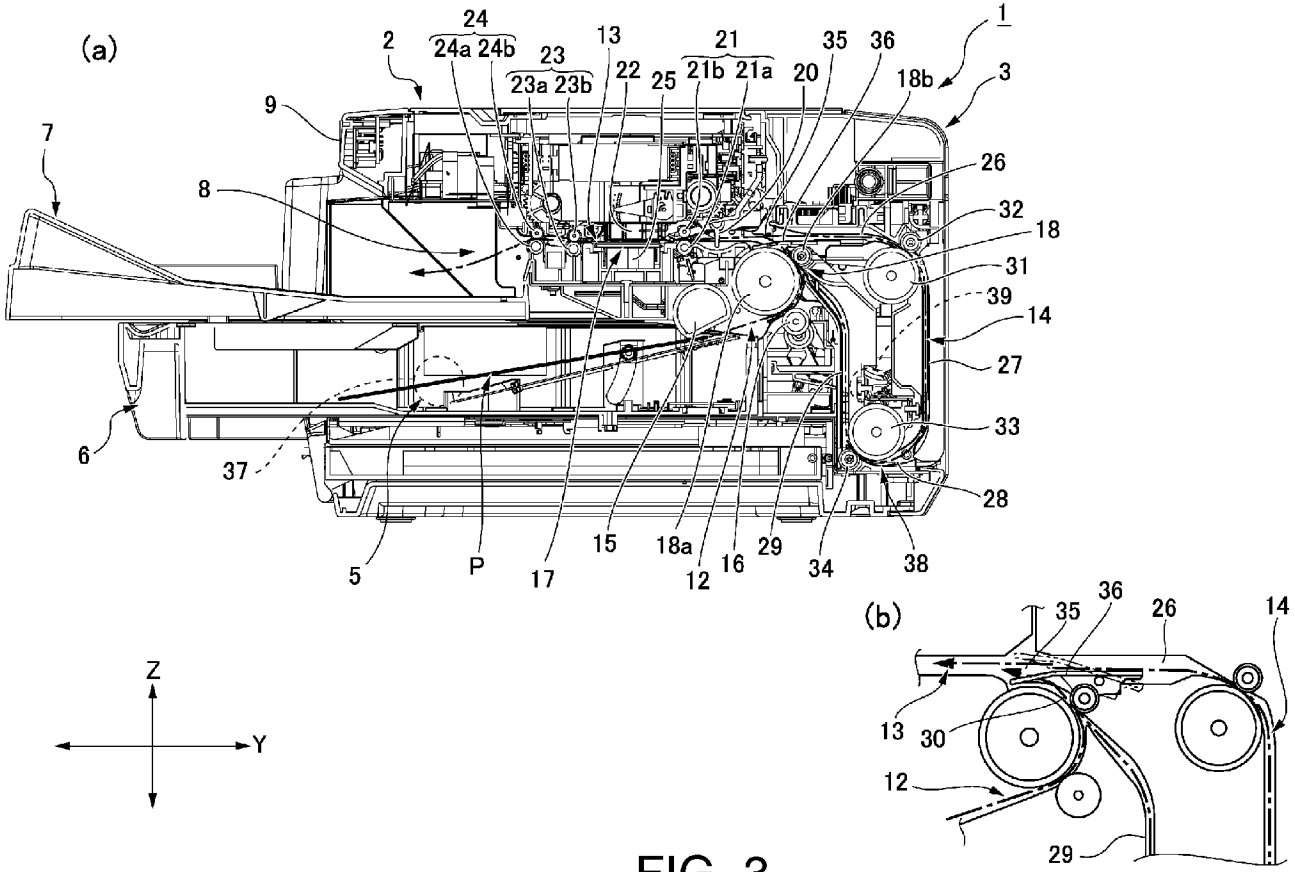
FIG. 3 is a vertical section view and a partial section view of the printer shown in FIG. 1.

FIG. 3A is a vertical section view schematically showing the internal configuration of the printer 1, and FIG. 3B is a partial vertical section view. The internal configuration of the printer 1, and particularly the paper conveyance path, is described next with reference to FIG. 3A and FIG. 3B. A printing paper supply path 12, main conveyance path (conveyance path) 13, and reversing conveyance path 14 are formed inside the printer 1. The printing paper supply path 12 and main conveyance path 13 are formed inside the printer cabinet 2, and the reversing conveyance path 14 is formed inside the reversing unit 3.

The printing paper supply path 12 is a conveyance path that conveys paper P of a specific size stored in a stack in the paper cassette 6 to the main conveyance path 13. The printing paper supply path 12 and paper cassette 6 are disposed below the main conveyance path 13. The printing paper supply path 12 extends diagonally up from the back end of the paper cassette loading unit 5 on the longitudinal axis Y, curves toward the front, and connects to the main conveyance path 13. Paper P stored in the paper cassette 6 is fed by a paper feed roller 15 to the printing paper supply path 12. The supplied printing paper is fed one sheet at a time through the nipping part of a retard roller 16 and conveyance roller 18*a*, and through the nipping part of the conveyance roller 18*a* and a follower roller 18*b* to the main conveyance path 13.

The main conveyance path 13 is the conveyance path extending straight substantially horizontally along the longitudinal axis Y to the paper exit 8. Disposed along the main conveyance path 13 from the back of the printer to the front are a printing paper detector 20, a paper feed roller pair 21, a printhead 22, a first discharge roller pair 23, and a second discharge roller pair 24. The printhead 22 and printing paper detector 20 are disposed above the main conveyance path 13. The printhead 22 is an inkjet head, and a platen 25 is disposed opposite the nozzle face with a specific gap therebetween.

The main conveyance mechanism 17 (conveyance mechanism, external conveyance mechanism) that conveys the printing paper P along the main conveyance path 13 includes a conveyance roller pair 18 including the conveyance roller 18*a* and follower roller 18*b*, a paper feed roller pair 21 including a paper feed roller 21*a* and follower roller 21*b*, a first discharge roller pair 23 including a first discharge roller 23*a* and a follower roller 23*b*, and a second discharge roller pair 24 including a second discharge roller 24*a* and follower roller 24*b*. The paper feed roller 21*a* of the paper feed roller pair 21 has a friction layer composed of inorganic particles dispersed in the surface. The drive source of the main conveyance mechanism 17 is a conveyance motor 37 that can be driven forward and reverse. The conveyance motor 37 is disposed beside the paper cassette 6 on the transverse axis X.

Drive power from the conveyance motor 37 is transferred through a drive power transfer mechanism not shown to the conveyance roller 18*a*, paper feed roller 21*a*, first discharge roller 23*a*, and second discharge roller 24*a*. The main conveyance mechanism 17 conveys the printing paper P toward the front of the printer when the conveyance motor 37 turns in the forward direction, and conveys the printing paper P toward the back of the printer when the conveyance motor 37 turns in the opposite direction. The printhead 22 prints while the printing paper P is conveyed toward the front of the printer through the main conveyance path 13 by the main conveyance mechanism 17.

The printing paper P fed from the printing paper supply path 12 to the main conveyance path 13 is conveyed by the conveyance roller pair 18 to the paper feed roller pair 21 while pushing up on the printing paper detector 20. The printing paper P fed into the paper feed roller pair 21 is conveyed past the printing position of the printhead 22 by the paper feed roller pair 21 toward the first discharge roller pair 23 to the front of the printer. The printing paper P fed to the first discharge roller pair 23 passes the first discharge roller pair 23 and second discharge roller pair 24, and is discharged from the paper exit 8 onto the paper discharge tray 7.

The reversing conveyance path 14 formed inside the reversing unit 3 is located below the main conveyance path 13 on the vertical axis Z, and is a conveyance path that forms a basic loop. The reversing conveyance path 14 includes an upstream path 26 that connects to the upstream end of the main conveyance path 13 and extends substantially horizontally to the back of the printer, a descending path 27 that curves and extends down in a straight line on the vertical axis Z from the upstream path 26, a bottom path 28 that connects to the descending path 27 and curves to the front of the printer, and an ascending path 29 that curves and extends upward from the bottom path 28.

The top part of the ascending path 29 curves at an angle to the printer front, and merges with the printing paper supply path 12 in the middle. More specifically, ascending path 29 and the downstream part of the printing paper supply path 12 form a common path 30. This common path 30 is a curved path extending along the outside of the conveyance roller 18*a*.

A first reversing conveyance roller 31 and a follower roller 32 are disposed between the upstream path 26 and the descending path 27, and a second reversing conveyance roller 33 and a follower roller 34 are disposed between the bottom path 28 and the ascending path 29. The first reversing conveyance roller 31, follower roller 32, second reversing conveyance roller 33, and follower roller 34 render a reversing conveyance mechanism 38 that conveys the printing paper P in one direction through the reversing conveyance path 14. The drive source of the reversing conveyance mechanism 38 is a reversing conveyance motor 39 that is separate from the conveyance motor 37, and is included in the reversing unit 3.

The printing paper P conveyed to the back by the main conveyance mechanism 17 and fed from the main conveyance path 13 into the reversing conveyance path 14 is nipped by the first reversing conveyance roller 31 and follower roller 32 and conveyed by the first reversing conveyance roller 31 to between the second reversing conveyance roller 33 and follower roller 34, and is then received by the second reversing conveyance roller 33 to the nipping part of the conveyance roller pair 18 of the main conveyance mechanism 17. The printing paper P is then fed by the conveyance roller pair 18 into the main conveyance path 13 again.

Bypassing through the loop of the reversing conveyance path 14, the printing paper P is reversed front and back and returned to the main conveyance path 13. The printer 1 can therefore print on both sides of the printing paper P. The conveyance speed of the printing paper P by the main conveyance mechanism 17 is set to a faster speed than the conveyance speed of the reversing conveyance mechanism 38. The conveyance force of the first reversing conveyance roller 31 and follower roller 32 is also weaker than the conveyance force of the paper feed roller pair 21, and the conveyance force of the second reversing conveyance roller 33 and follower roller 34 is weaker than the conveyance force of the conveyance roller pair 18. The conveyance force is the product of the nipping force and the friction coefficient.

Paper conveyed from the main conveyance path 13 to the reversing conveyance path 14 is nipped by the first reversing conveyance roller 31 and follower roller 32, then conveyed by the first reversing conveyance roller 31 to the nipping part of the second reversing conveyance roller 33 and follower roller 34, and then conveyed by the second reversing conveyance roller 33 to the nipping part of the conveyance roller 17 and follower roller 18. The paper is then fed by the conveyance roller 18*a* to the main conveyance path 13 again.

Printing paper P conveyed toward the back of the printer through the main conveyance path 13 is guided by the path-changing flapper 36 to the reversing conveyance path 14 side. The printing paper P then passes through the reversing conveyance path 14 and returns to the junction 35. The path-changing flapper 36 is pushed up by the printing paper P returned to the junction 35, and can move from the first position to a second position. When the path-changing flapper 36 is pushed up to the second position, the common path 30 at the downstream end of the reversing conveyance path 14 communicates with the main conveyance path 13. The printing paper P is therefore conveyed to the main conveyance path 13 while pushing the path-changing flapper 36 up. After the printing paper P has passed, the path-changing flapper 36 returns by its own weight to the first position.

The path-changing flapper 36 is also pushed up by the printing paper P fed from the printing paper supply path 12 to the main conveyance path 13 when paper is supplied from the paper cassette 6. After the printing paper P passes, the path-changing flapper 36 returns of its own weight to the first position. Printing paper P reversed from the main conveyance path 13 will therefore not go through the common path 30 into the reversing conveyance path 14 or the printing paper supply path 12. The path of the printing paper P can also be changed by a simple configuration without using a separate drive power source or urging member.

Reversing Unit

Figure 4:
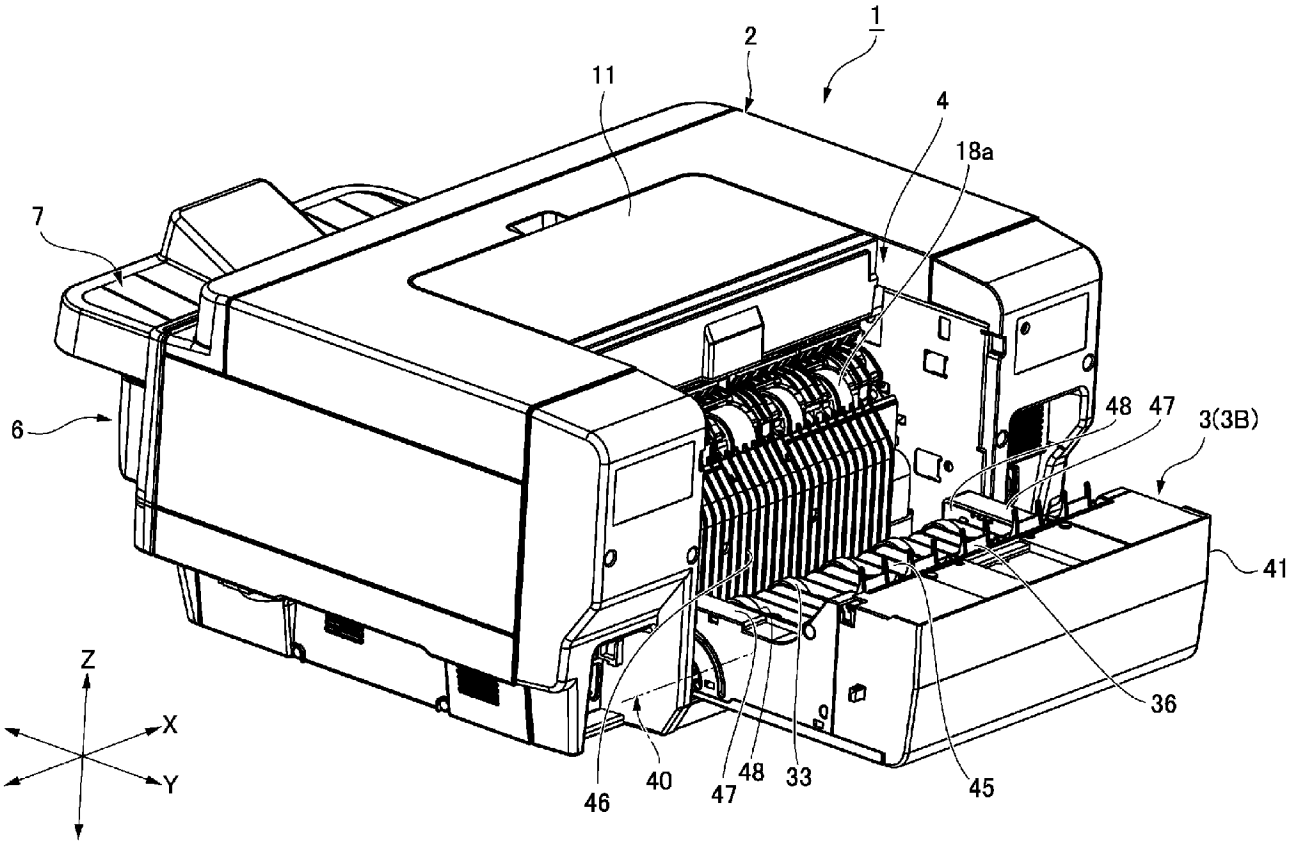
FIG. 4 is an oblique rear view of the printer in FIG. 1 when the reversing unit is open.
Figure 5:
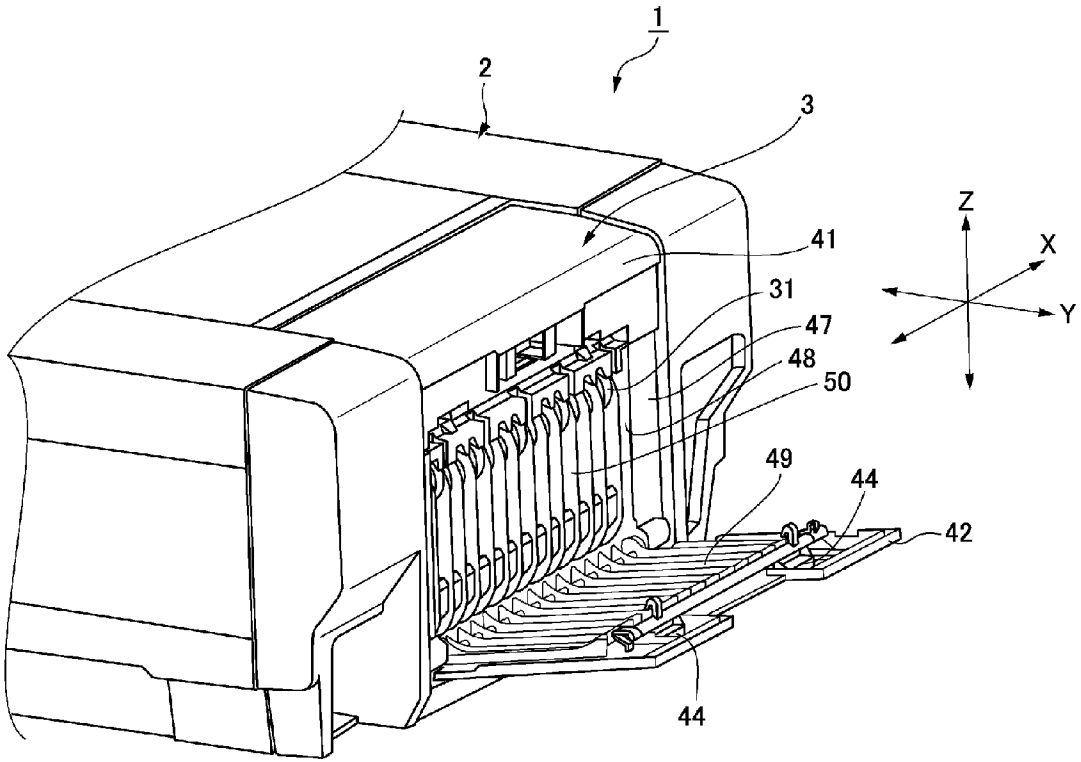
FIG. 5 is an oblique view of the printer in FIG. 1 from the back when the back cover is open.

FIG. 4 is an external oblique view from the back of the printer 1 when the reversing unit 3 is open. FIG. 5 is an oblique view showing the reversing unit 3 in the closed position 3A with the back cover 42 of the reversing unit 3 open. Operating the lever operating unit 43 (FIG. 2) in the back of the printer 1 unlocks the reversing unit 3. As a result, the reversing unit 3 can open by pivoting at the pivot axis 40 located at the bottom on the vertical axis Z. When in the open position 3B, the reversing unit 3 is dropped to the back of the printer to a substantially horizontal position.

When the reversing unit 3 is in the open position 3B, the ascending path 29 and the common path 30 of the reversing conveyance path 14 are open. When the reversing unit 3 is in the closed position 3A, the front paper guide 45 of the reversing unit 3 and the ribbed paper guide surface 46 of the printer cabinet 2 are opposed with a specific gap therebetween, forming the ascending path 29 and common path 30.

The maximum width of the transverse axis X of the ascending path 29 is determined by the end panels 47 of the reversing unit case 41. The inside surfaces of the end panels 47 are flat frame panels 48 that rotatably support the ends of the roller shafts 71 (see FIG. 6) of the first reversing conveyance roller 31 and the second reversing conveyance roller 33. The path-changing flapper 36 is disposed to the top end of the front paper guide 45 of the reversing unit 3.

Operating the pair of operating levers 44 (FIG. 2) in the back of the printer 1 unlocks the back cover 42. As a result, the back cover 42 can open to the back pivoting on the bottom end on the vertical axis Z. When the back cover 42 opens, the descending path 27 of the reversing conveyance path 14 opens as shown in FIG. 5. When the back cover 42 closes, the ribbed paper guide surface 49 on the inside of the back cover 42 and the back paper guide 50 of the reversing unit 3 are opposed with a specific gap therebetween, forming the descending path 27.

Reversing Conveyance Mechanism

Figure 6:
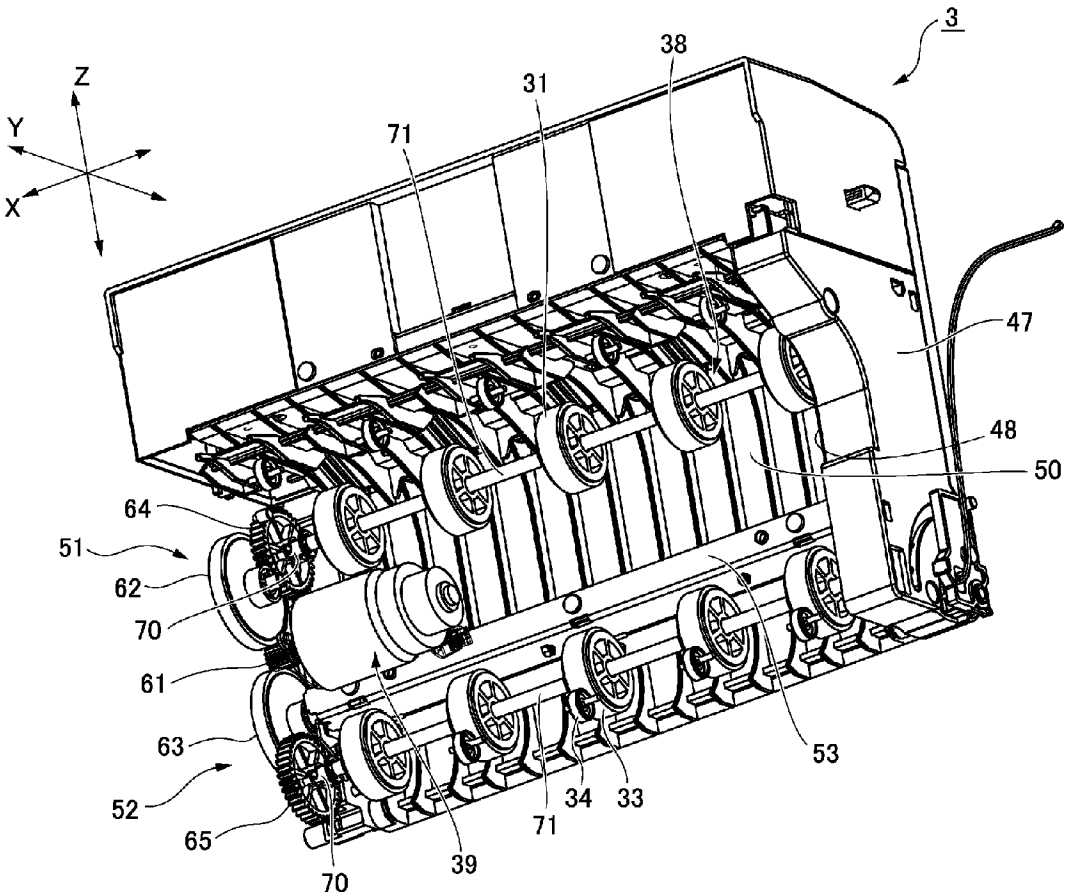
FIG. 6 is a front oblique view showing the inside of the reversing unit.

FIG. 6 is an oblique view of the reversing unit 3 without the front paper guide 45 and one of the end panels 47 and frame panels 48. As shown in FIG. 6, the reversing conveyance mechanism 38 of the reversing unit 3 includes the first and second reversing conveyance rollers 31, 33; the reversing conveyance motor 39; and first and second gear trains 51, 52 that respectively transfer rotation of the reversing conveyance motor 39 to the first and second reversing conveyance rollers 31, 33.

The reversing conveyance motor 39 is disposed substantially horizontally on the transverse axis X at a position beside one frame panel 48 between the front paper guide 45 and back paper guide 50. A connecting bar 53 spans the transverse axis X between the frame panels 48, and the reversing conveyance motor 39 is attached to the connecting bar 53.

The shaft of the reversing conveyance motor 39 passes through the frame panel 48 into the space between the one frame panel 48 and the corresponding end panel 47. The first gear train 51 and the second gear train 52 are disposed in the space between the frame panel 48 and end panel 47.

The first gear train 51 includes a pinion 61 fixed to the end of the motor shaft; a first compound transfer gear 62 that meshes with the pinion 61 from above the pinion 61; and a first final gear 64 that meshes with the first compound transfer gear 62 from above the first compound transfer gear 62.

The second gear train 52 includes the pinion 61 fixed to the end of the motor shaft; a second compound transfer gear 63 that meshes with the pinion 61 from below the pinion 61; and a second final gear 65 that meshes with the second compound transfer gear 63 from below the second compound transfer gear 63.

The first final gear 64 and second final gear 65 are respectively disposed coaxially to the first reversing conveyance roller 31 and second reversing conveyance roller 33, and transfer drive power (rotation) of the reversing conveyance motor 39 to the first reversing conveyance roller 31 and the second reversing conveyance roller 33. When the reversing conveyance motor 39 is driven, the first and second reversing conveyance rollers 31, 33 rotate synchronously in the same direction at the same circumferential speed.

A backlash part 70 allowing rotation within a preset angular range between the first final gear 64 and the first reversing conveyance roller 31, and between the second final gear 65 and the second reversing conveyance roller 33, is provided between the top first final gear 64 and the first reversing conveyance roller 31, and between the bottom second final gear 65 and the second reversing conveyance roller 33.

Backlash Part

Figure 7:
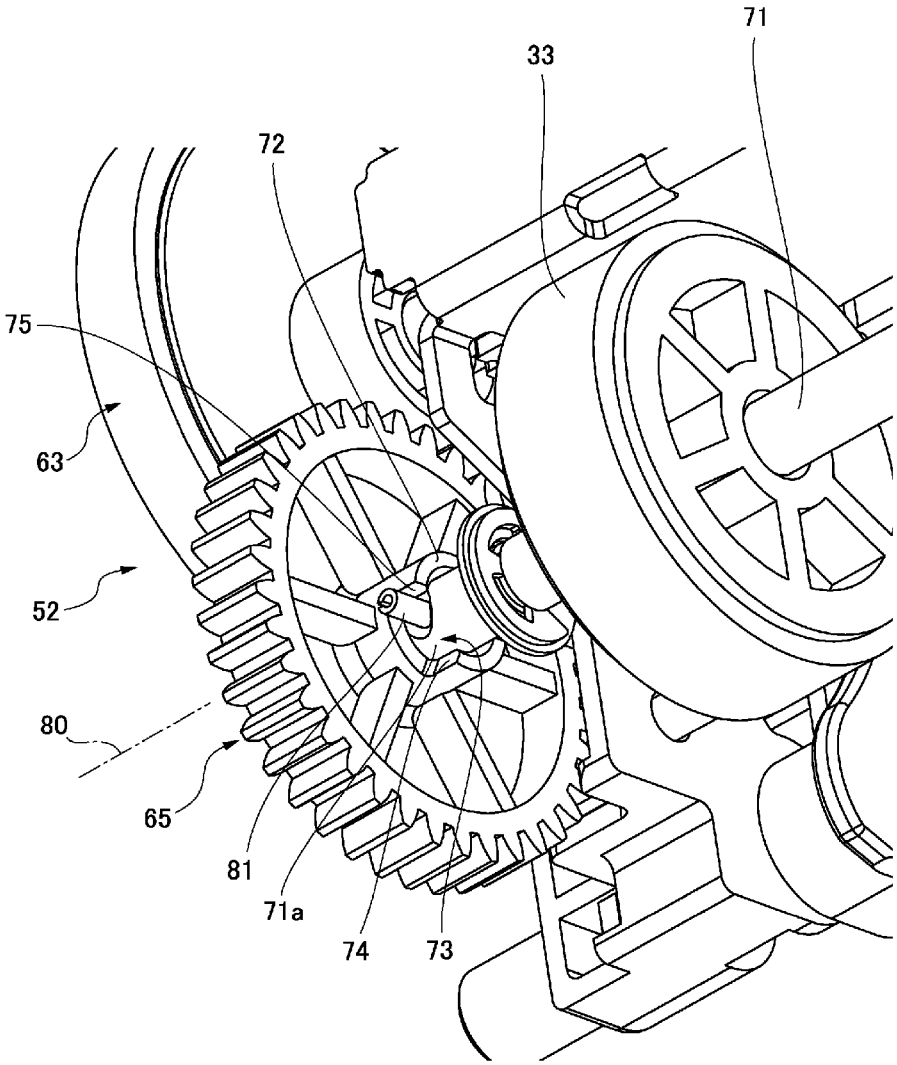
FIG. 7 shows the backlash area between the second final gear and second reversing conveyance roller.

FIG. 7 is an enlarged view of the area around the second final gear 65 from the second reversing conveyance roller 33 side. The backlash part 70 is described with reference to FIG. 7. Note that because the backlash part 70 between the first final gear 64 and the first reversing conveyance roller 31, and the backlash part 70 between the second final gear 65 and the second reversing conveyance roller 33, are identical, the backlash part 70 between the second final gear 65 and the second reversing conveyance roller 33 is described below, and description of the backlash part 70 between the first final gear 64 and the first reversing conveyance roller 31 is omitted.

The end of the roller shaft 71 (axis of rotation) of the second reversing conveyance roller 33 is rotatably supported by the frame panel 48 not shown. The second final gear 65 is rotatably supported by the end 71*a* of the roller shaft 71 of the second reversing conveyance roller 33 and a bearing (not shown in the figure) disposed inside the end panel 47.

More specifically, the second final gear 65 has a cylindrical shaft pocket 72 that protrudes to the second reversing conveyance roller 33 side coaxially to the axis of rotation. The shaft pocket 72 has a pair of notches 73 recessed from the second reversing conveyance roller 33 side at two circumferential locations. The pair of notches 73 are point symmetrical to the axis 80 of the second final gear 65. The roller shaft 71 of the second reversing conveyance roller 33 has a pair of pins 81 protruding radially from opposite sides of the shaft end 71*a*. The end 71*a* of the roller shaft 71 is inserted coaxially to the shaft pocket 72 with the pair of pins 81 inserted to the notches 73.

Each notch 73 has a pair of inside surfaces 74, 75. One inside surface 74 can contact the pin 81 from one side around the axis 80, and the other inside surface 75 can contact the pin 81 from the other side around the axis 80. The end 71*a* of the roller shaft 71 is inserted to the shaft pocket 72 so that the roller shaft 71 can rotate independently of the second final gear 65. The second final gear 65 and the second reversing conveyance roller 33 can therefore move relatively to each other within the range of motion of the pins 81 between the inside surfaces 74 and the inside surfaces 75. In other words, a backlash part 70 enabling the second final gear 65 and second reversing conveyance roller 33 to move relative to each other circumferentially to the notches 73 through the range of the open angle (set angle) defined by the one inside surface 74 and the other inside surface 75 is provided.

Duplex Printing Operation

Figure 8:
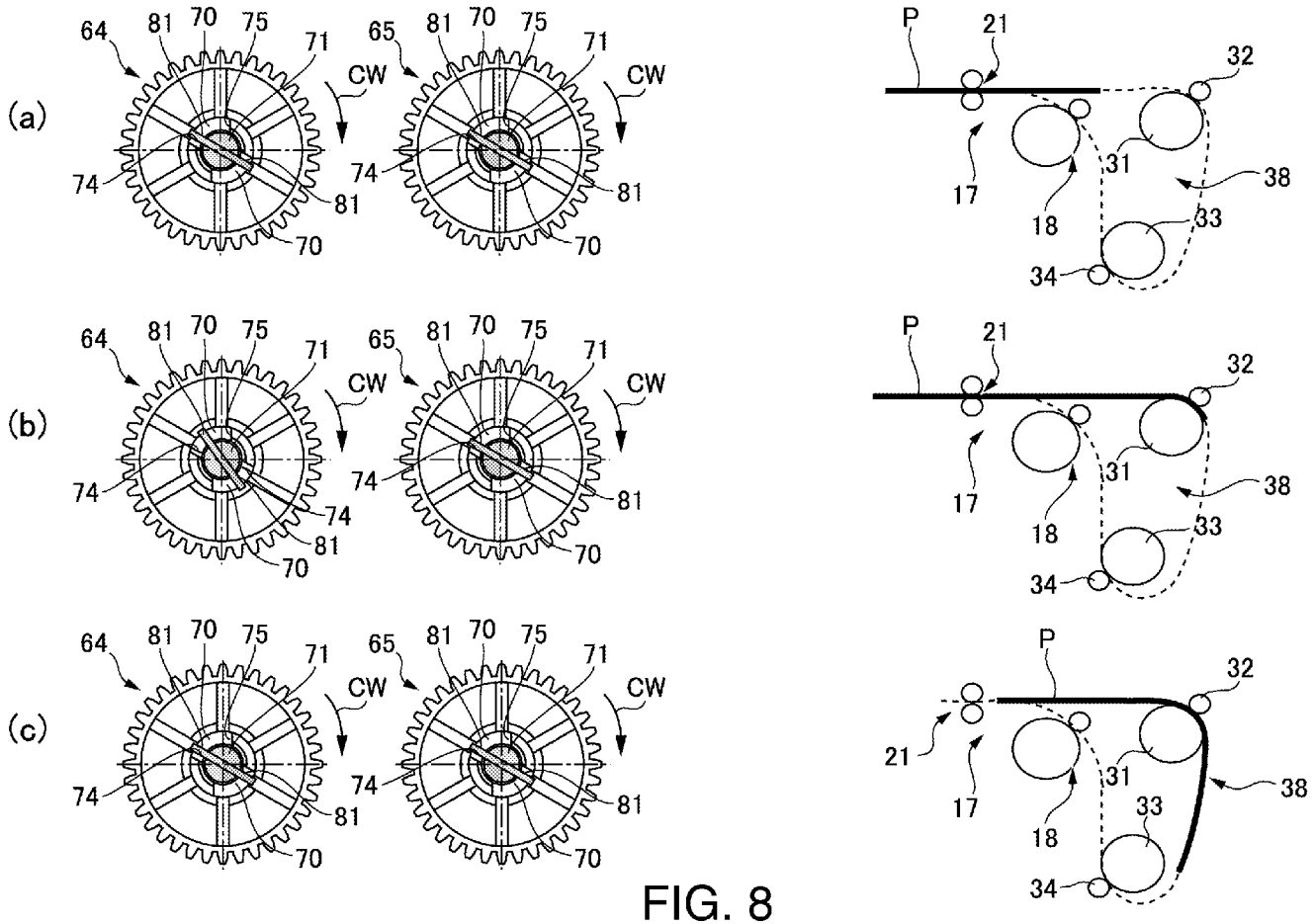
FIGS. 8 (*a*)-8 (*c*) describe the operation passing the printing paper to the reversing conveyance mechanism.
Figure 9:
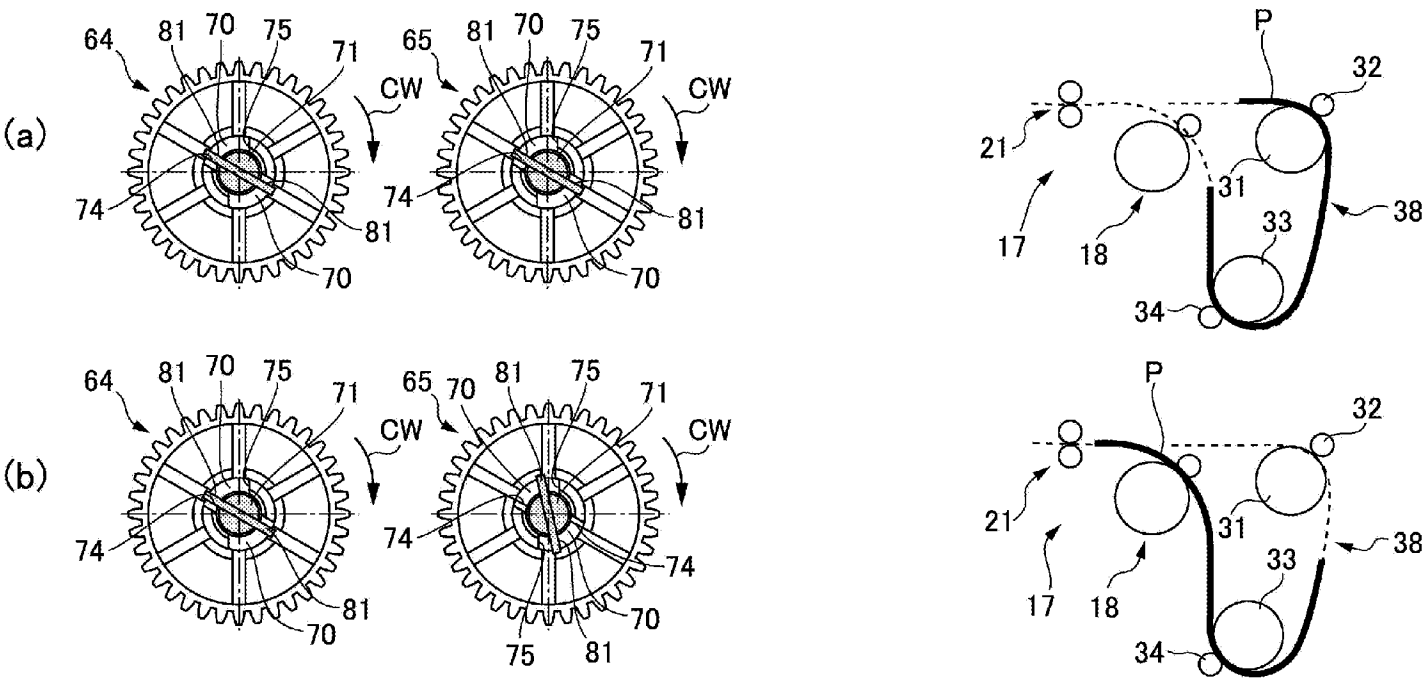
FIGS. 9 (*a*) and 9 (*b*) describe the operation passing the printing paper to the main conveyance mechanism.

The duplex printing operation of the printer 1 is described below with reference to FIGS. 8 (*a*)-8 (*c*) and FIGS. 9 (*a*) and 9 (*b*). FIGS. 8 (*a*)-8 (*c*) describe the operation passing the printing paper P from the main conveyance mechanism 17 to the reversing conveyance mechanism 38. FIGS. 9 (*a*) and 9 (*b*) describe the operation passing the printing paper P from the reversing conveyance mechanism 38 to the main conveyance mechanism 17. The figures on the left side in FIGS. 8 (*a*)-8 (*c*) and FIGS. 9 (*a*) and 9 (*b*) describe the relative positions of the backlash part 70 of the first final gear 64 and the pin 81 in the roller shaft 71 of the first reversing conveyance roller 31, and the figures in the middle describe the relative positions of the backlash part 70 of the second final gear 65 and the pin 81 in the roller shaft 71 of the second reversing conveyance roller 33. The figures on the right show the position of the printing paper P relative to the paper feed roller pair 21, first reversing conveyance roller 31, follower roller 32, second reversing conveyance roller 33, follower roller 34, and conveyance roller pair 18.

For the printer 1 to print on both sides of the paper, printing paper P stored in the paper cassette 6 is first fed by the paper feed roller 15 into the paper supply path 12. The conveyance motor 37 is also driven forward, and the printing paper P delivered to the paper supply path 12 is conveyed by the retard roller 16 and conveyance roller pair 18 to the main conveyance path 13. The printing paper P delivered into the main conveyance path 13 is then conveyed toward the front of the printer by the main conveyance mechanism 17 past the printing position of the printhead 22. The printhead 22 prints on the front (first) side as the printing paper P passes the printing position.

When printing on the front of the printing paper P is completed, the conveyance motor 37 is driven in reverse. The reversing conveyance motor 39 is also driven. By driving the conveyance motor 37, the printing paper P is conveyed toward the back of the printer by the main conveyance mechanism 17, and fed from the main conveyance path 13 into the reversing conveyance path 14.

When the reversing conveyance motor 39 is driven at this time, the first final gear 64 of the first gear train 51 and the second final gear 65 of the second gear train 52 turn at the same in the same direction CW. As a result, as shown in FIG. 8 (*a*), the pin 81 in the roller shaft 71 of the first reversing conveyance roller 31 stopped at a position around the axis 80 contacts the inside surface 74 of the notch 73 in the first final gear 64. The pin 81 in the roller shaft 71 of the second reversing conveyance roller 33 stopped at a position around the axis 80 contacts the inside surface 74 of the notch 73 in the second final gear 65. The first final gear 64 and first reversing conveyance roller 31 therefore rotate together, and the second final gear 65 and second reversing conveyance roller 33 rotate together.

The leading end in the conveyance direction of the printing paper P (the end toward the back of the printer) conveyed by the main conveyance mechanism 17 then reaches the nipping point between the first reversing conveyance roller 31 and follower roller 32, and is nipped therebetween. The trailing end of the paper P in the conveyance direction (the end toward the front of the printer) remains nipped by the paper feed roller pair 21 at this time. The printing paper P is therefore conveyed by both the main conveyance mechanism 17 (paper feed roller pair 21) and the reversing conveyance mechanism 38 (first reversing conveyance roller 31 and follower roller 32).

The conveyance speed of the printing paper P by the main conveyance mechanism 17 is set to a higher speed than the conveyance speed by the reversing conveyance mechanism 38. The first reversing conveyance roller 31 therefore rotates with the printing paper P conveyed by the main conveyance mechanism 17, and starts to rotate forward indirection of rotation CW relative to the first final gear 64. As a result, as shown in FIG. 8 (*b*), the pin 81 in the roller shaft 71 of the first reversing conveyance roller 31 separates from the one inside surface 74 of the notch 73 in the first final gear 64, and begins approaching the inside surface 75 on the other side.

Relative rotation of the first reversing conveyance roller 31 and first final gear 64 continues as long as the printing paper P is conveyed by both the main conveyance mechanism 17 (paper feed roller pair 21) and the reversing conveyance mechanism 38 (first reversing conveyance roller 31 and follower roller 32).

More specifically, the open angle of the notch 73 is set to an angle in which the pin 81 in the roller shaft 71 of the first reversing conveyance roller 31 will not contact the other inside surface 75 of the notch 73 in the first final gear 64 while the printing paper P is conveyed by both the main conveyance mechanism 17 and reversing conveyance mechanism 38.

More specifically, the open angle is set to an angle in which the pin 81 will not contact the other inside surface 75 of the notch 73 when the printing paper P is passed based on conditions (1) to (7) below.

(1) conveyance speed (circumferential speed) by the paper feed roller pair 21

(2) conveyance speed (circumferential speed) by the first reversing conveyance roller 31 and follower roller 32

(3) manufacturing tolerance in the diameter of the paper feed roller 21*a*

(4) manufacturing tolerance in the diameter of the first reversing conveyance roller 31

(5) deviation from the target conveyance speed of the paper feed roller pair 21

(6) deviation from the target conveyance speed of the first reversing conveyance roller 31 and follower roller 32

(7) conveyance distance of the printing paper P by the paper feed roller pair 21 and the first reversing conveyance roller 31 and follower roller 32

In this example, the open angle of the notch 73 in the first final gear 64 is 39 degrees or greater.

In this example, the first reversing conveyance roller 31 and first final gear 64 turn in relation to each other within the range of the backlash part 70 and absorb the difference in the conveyance speed of each while the printing paper P is conveyed by both the main conveyance mechanism 17 and reversing conveyance mechanism 38. Slack and excess tension on the printing paper P are therefore prevented, and conveyance of the printing paper P is prevented from becoming unstable, when the printing paper P is passed from the main conveyance mechanism 17 to the reversing conveyance mechanism 38.

When the printing paper P is completely passed to the reversing conveyance mechanism 38, the first reversing conveyance roller 31 stops rotating with the printing paper P, and the rotational velocity of the first reversing conveyance roller 31 drops. As a result, rotation of the first final gear 64 catches up with rotation of the first reversing conveyance roller 31, and the pin 81 in the roller shaft 71 of the first reversing conveyance roller 31 starts to separate from the other inside surface 75 of the notch 73 in the first final gear 64. Finally, as shown in FIG. 8 (*c*), the pin 81 in the roller shaft 71 of the first reversing conveyance roller 31 again contacts the one inside surface 74 of the notch 73, and the first reversing conveyance roller 31 and the first final gear 64 turn together. In the state shown in FIG. 8 (*c*), the printing paper P is conveyed by only the first reversing conveyance roller 31.

Once passing the printing paper P to the reversing conveyance mechanism 38 is completed, the trailing end in the conveyance direction of the printing paper P (the end towards the front of the printer) passes the printing paper detector 20, and the drive direction of the conveyance motor 37 changes from reverse to forward based on output from the printing paper detector 20.

Next, the leading end in the conveyance direction of the printing paper P reaches the nipping point of the second reversing conveyance roller 33 and follower roller 34 and is nipped therebetween due to conveyance by the first reversing conveyance roller 31 and follower roller 32. As a result, the printing paper P is conveyed both by the first reversing conveyance roller 31 and follower roller 32 and by the second reversing conveyance roller 33 and follower roller 34 as shown in FIG. 9 (*a*).

The first and second reversing conveyance rollers 31, 33 also rotate synchronously at the same circumferential speed in the same direction of rotation CW by the drive power from the same drive source (reversing conveyance motor 39). Therefore, when the printing paper P is passed from the first reversing conveyance roller 31 and follower roller 32 to the second reversing conveyance roller 33 and follower roller 34, the first final gear 64 and first reversing conveyance roller 31 do not rotate relative to each other. The second final gear 65 and second reversing conveyance roller 33 also do not rotate relative to each other. As a result, the state shown in FIG. 9 (*a*) is the same as the state shown in FIG. 8 (*c*).

The leading end in the conveyance direction of the printing paper P then reaches the nipping point of the conveyance roller pair 18 and is nipped therebetween. The trailing end in the conveyance direction of the printing paper P remains nipped by the first reversing conveyance roller 31 and follower roller 32. The printing paper P is therefore conveyed both by the reversing conveyance mechanism 38 (second reversing conveyance roller 33 and follower roller 34) and the main conveyance mechanism 17 (paper feed roller pair 21).

The conveyance speed of the printing paper P by the main conveyance mechanism 17 is set to a higher speed than the conveyance speed by the reversing conveyance mechanism 38. The second reversing conveyance roller 33 therefore rotates with the printing paper P conveyed by the main conveyance mechanism 17, and starts to rotate forward indirection of rotation CW relative to the second final gear 65. As a result, as shown in FIG. 9 (*b*), the pin 81 in the roller shaft 71 of the second reversing conveyance roller 33 separates from the one inside surface 74 of the notch 73 in the second final gear 65, and begins approaching the inside surface 75 on the other side.

Relative rotation of the second reversing conveyance roller 33 and second final gear 65 continues as long as the printing paper P is conveyed by both the reversing conveyance mechanism 38 (second reversing conveyance roller 33 and follower roller 34) and the main conveyance mechanism 17 (conveyance roller pair 18).

More specifically, the open angle of the notch 73 is set to an angle in which the pin 81 in the roller shaft 71 of the second reversing conveyance roller 33 will not contact the other inside surface 75 of the notch 73 in the second final gear 65 while the printing paper P is conveyed by both the reversing conveyance mechanism 38 and the main conveyance mechanism 17.

More specifically, the open angle is set to an angle in which the pin 81 will not contact the other inside surface 75 of the notch 73 when the printing paper P is passed based on conditions (1) to (7) below.

(1) conveyance speed (circumferential speed) by the conveyance roller pair 18

(2) conveyance speed (circumferential speed) by the second reversing conveyance roller 33 and follower roller 34

(3) manufacturing tolerance in the diameter of the conveyance roller 18*a*

(4) manufacturing tolerance in the diameter of the second reversing conveyance roller 33

(5) deviation from the target conveyance speed of the conveyance roller pair 18

(6) deviation from the target conveyance speed of the second reversing conveyance roller 33 and follower roller 34

(7) conveyance distance of the printing paper P by the conveyance roller pair 18 and the second reversing conveyance roller 33 and follower roller 34

In this example, the open angle of the notch 73 in the second final gear 65 is 51 degrees or greater.

In this example, the second reversing conveyance roller 33 and second final gear 65 turn in relation to each other within the range of the backlash part 70 and absorb the difference in the conveyance speed of each while the printing paper P is conveyed by both the reversing conveyance mechanism 38 and the main conveyance mechanism 17. Slack and excess tension on the printing paper P are therefore prevented, and conveyance of the printing paper P is prevented from becoming unstable, when the printing paper P is passed from the reversing conveyance mechanism 38 to the main conveyance mechanism 17.

The second reversing conveyance roller 33 stops rotating with the printing paper P when the printing paper P is completely passed to the main conveyance mechanism 17. The printing paper P is also conveyed toward the front of the printer through the main conveyance path 13 by only the main conveyance mechanism 17, passes the printing position of the printhead 22, and the back (second) side is printed. When printing on the back ends, the main conveyance mechanism 17 continues conveying the printing paper P forward and discharges the paper from the paper exit 8.

Effect

As described above, by simply providing a backlash part 70, the invention enables absorbing the difference in the conveyance speeds of the main conveyance mechanism 17 and reversing conveyance mechanism 38.

In this example the conveyance force of the first reversing conveyance roller 31 and follower roller 32 is weaker than the conveyance force of the paper feed roller pair 21, and the conveyance force of the second reversing conveyance roller 33 and follower roller 34 is weaker than the conveyance force of the conveyance roller pair 18. Therefore, when the conveyance speed of the reversing conveyance mechanism 38 exceeds the conveyance speed of the main conveyance mechanism 17, the printing paper P slips against the first and second reversing conveyance rollers 31, 33 and the conveyance speed difference is absorbed.

OTHER EXAMPLES

The printing paper P is conveyed only by the main conveyance mechanism 17 when the printing paper P passes the printing position of the printhead 22 in the above example, but the printing paper P could be conveyed by both the reversing conveyance mechanism 38 (second reversing conveyance roller 33 and follower roller 32) and the main conveyance mechanism 17 while the printing paper P passes the printing position of the printhead 22. More specifically, because conveyance of the paper P is not unstable and the paper feed load does not change when the printing paper P is passed in the printer 1 according to this embodiment of the invention, the printing paper P can be conveyed with good precision by the main conveyance mechanism 17 without reducing print quality even if the printing paper P is passed from the reversing conveyance mechanism 38 (second reversing conveyance roller 33 and follower roller 32) to the main conveyance mechanism 17 parallel to the printing operation.

A backlash part 70 is provided between the top first final gear 64 and the first reversing conveyance roller 31, and between the bottom second final gear 65 and the second reversing conveyance roller 33, in the above embodiment. Alternatively, a backlash part enabling relative rotation within a set angular range between two gears that directly transfer the drive power of the reversing conveyance motor 39 could be provided between the two gears in the first gear train 51 and second gear train 52.

The foregoing embodiment describes the invention used in a printer 1 capable of duplex printing, but the invention can obviously also be applied in media processing devices with a reversing unit 3 other than a printer 1, including scanners and facsimile machines.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A media processing device comprising:

a conveyance path that guides a sheet medium;

a drive source that conveys the medium along the conveyance path;

a conveyance mechanism that conveys the medium by the drive source in one direction and the opposite direction through the conveyance path;

a reversing conveyance path that reverses the front and back of the medium supplied by the conveyance mechanism from the conveyance path, and returns the medium to the conveyance path;

a reversing conveyance mechanism that receives and conveys the medium fed into the reversing conveyance path through the reversing conveyance path, and then feeds the medium into the conveyance path and passes the medium to the conveyance mechanism;

a reversing drive source that is separate from the drive source and drives the reversing conveyance mechanism; and a backlash part including a pin and first and second contact parts;

the reversing conveyance mechanism including a reversing conveyance roller, and a gear train that transfers drive power from the reversing drive source to the reversing conveyance roller; and the backlash part enabling relative rotation in a preset angular range between two gears to which the drive power of the reversing drive source is directly transferred in the gear train, or between a final gear of the gear train and the reversing conveyance roller;

the two gears are disposed on a center shaft;

the pin protrudes radially from the center shaft part;

the final gear has a first contact part that contacts the pin from one side and a second contact part that contacts the pin from the other side around the axis of rotation.

2. The media processing device described in claim 1, wherein:

the reversing conveyance mechanism includes a first reversing conveyance roller and a second reversing conveyance roller as the reversing conveyance roller, and includes a first gear train that transfers the drive power of the reversing drive source to the first reversing conveyance roller, and a second gear train that transfers the drive power of the reversing drive source to the second reversing conveyance roller, as the gear train;

the first reversing conveyance roller conveys the medium with the conveyance mechanism when the medium is received from the conveyance mechanism; and the second reversing conveyance roller conveys the medium with the conveyance mechanism when passing the medium to the conveyance mechanism.

3. The media processing device described in claim 1, wherein:

the conveyance speed of the reversing conveyance mechanism is slower than the conveyance speed of the conveyance mechanism.

4. The media processing device described in claim 1, wherein:

the media conveyance force of the reversing conveyance mechanism is less than the media conveyance force of the conveyance mechanism.

5. The media processing device described in claim 1, wherein:

the backlash part is disposed between the final gear and reversing conveyance roller; and wherein the final gear and the reversing gear are disposed coaxially.

6. The media processing device described in claim 1, wherein:

the final gear and the reversing conveyance roller can rotate relative to each other in the range of the pin moving between the first contact part and the second contact part.

7. The media processing device described in claim 1, wherein:

the drive source can drive forward and reverse;

the conveyance mechanism conveys the medium in one direction through the conveyance path by the drive source driving forward, and conveys the medium in the other direction through the conveyance path by the drive source driving in reverse; and the reversing conveyance mechanism conveys the medium that is fed into the reversing conveyance path from the conveyance path by the conveyance mechanism being driven in reverse by the drive source through the reversing conveyance path, and then feeds the medium into the conveyance path and passes the medium to the conveyance mechanism driven forward by the drive source.

8. A paper reversing conveyance unit comprising:

a reversing conveyance path that reverses the front and back of a medium supplied from an external part through an external conveyance mechanism having a drive source and conveying sheet media, and returns the medium to the external conveyance mechanism;

a reversing conveyance mechanism that receives and conveys the medium fed into the reversing conveyance path from the external conveyance mechanism through the reversing conveyance path, and then passes the medium to the external conveyance mechanism;

a reversing drive source that drives the reversing conveyance mechanism; and a backlash mechanism;

the reversing conveyance mechanism including a reversing conveyance roller, and a gear train that transfers drive power from the reversing drive source to the reversing conveyance roller; and the backlash mechanism enabling relative rotation in a preset angular range between two gears to which the drive power of the reversing drive source is directly transferred in the gear train, or between a final gear of the gear train and the reversing conveyance roller.

9. The paper reversing conveyance unit described in claim 8, wherein:

the reversing conveyance mechanism includes a first reversing conveyance roller and a second reversing conveyance roller as the reversing conveyance roller, and includes a first gear train that transfers the drive power of the reversing drive source to the first reversing conveyance roller, and a second gear train that transfers the drive power of the reversing drive source to the second reversing conveyance roller, as the gear train;

the first reversing conveyance roller conveys the medium with the external conveyance mechanism when the medium is received from the external conveyance mechanism; and the second reversing conveyance roller conveys the medium with the external conveyance mechanism when passing the medium to the external conveyance mechanism.

10. The paper reversing conveyance unit described in claim 8, wherein:

the conveyance speed of the reversing conveyance mechanism is slower than the conveyance speed of the external conveyance mechanism.

11. The paper reversing conveyance unit described in claim 8, wherein:

the media conveyance force of the reversing conveyance mechanism is less than the media conveyance force of the external conveyance mechanism.

12. The paper reversing conveyance unit described in claim 8, wherein:

the backlash part is disposed between the final gear and reversing conveyance roller; and wherein the final gear and the reversing conveyance roller are disposed coaxially.

13. The paper reversing conveyance unit described in claim 8, wherein:

the backlash mechanism comprises a pin and first and second contact parts;

the reversing conveyance roller has a pin protruding radially from a center shaft part;

the final gear has a first contact part that contacts the pin from one side and a second contact part that contacts the pin from the other side around the axis of rotation; and the final gear and the reversing conveyance roller can rotate relative to each other in the range of the pin moving between the first contact part and the second contact part.

14. The paper reversing conveyance unit described in claim 8, wherein:

the reversing conveyance mechanism conveys the medium that is supplied from outside by the drive source of the external conveyance mechanism being driven in reverse through the reversing conveyance path, and then passes the medium to the external conveyance mechanism that is driven forward by the drive source.

* * * * *